US008141195B2

(12) United States Patent
Al-Sulaiman et al.

(10) Patent No.: US 8,141,195 B2
(45) Date of Patent: Mar. 27, 2012

(54) SIWAK TOOTH CLEANING INSTRUMENT

(75) Inventors: Faleh A. Al-Sulaiman, Dhahran (SA); Muhammad A. Hawwa, Dhahran (SA)

(73) Assignee: King Fahd University of Petroleum & Minerals, Dhahran (SA)

( * ) Notice: Subject to any disclaimer, the term of this patent is extended or adjusted under 35 U.S.C. 154(b) by 1022 days.

(21) Appl. No.: 12/081,025

(22) Filed: Apr. 9, 2008

(65) Prior Publication Data

US 2009/0258326 A1 Oct. 15, 2009

(51) Int. Cl.
*A61C 17/00* (2006.01)

(52) U.S. Cl. ..... 15/176.1; 15/167.1; 15/185

(58) Field of Classification Search ..... 15/167.1, 15/210.1, 176.1–176.6, 184, 185
See application file for complete search history.

(56) References Cited

U.S. PATENT DOCUMENTS

| | | | | |
|---|---|---|---|---|
| 2,443,361 | A | 6/1948 | Satz et al. | |
| 2,513,830 | A | 7/1950 | Voegeli | |
| 3,620,632 | A | 11/1971 | Gruska | |
| 3,706,500 | A | 12/1972 | Gruska | |
| 3,850,183 | A | 11/1974 | Gruska | |
| 4,579,134 | A | 4/1986 | Moore | |
| 5,003,658 | A * | 4/1991 | Rolleri | 15/185 |
| 5,009,886 | A | 4/1991 | Ahmad | |
| 5,382,107 | A * | 1/1995 | Nian | 401/191 |
| 5,471,701 | A | 12/1995 | Parfenie | |
| 5,531,318 | A | 7/1996 | Coleman et al. | |
| 5,768,737 | A | 6/1998 | Leutwyler et al. | |
| 5,864,915 | A * | 2/1999 | Ra | 15/167.1 |
| 5,939,049 | A | 8/1999 | Miller et al. | |
| 6,009,886 | A | 1/2000 | Labranche et al. | |
| 6,290,417 | B1 | 9/2001 | Kaminski | |
| 6,490,747 | B1 | 12/2002 | Metwally | |
| 6,612,770 | B2 | 9/2003 | Aoyama | |
| 6,643,887 | B1 | 11/2003 | Foley et al. | |
| 6,671,920 | B2 | 1/2004 | Pearlman et al. | |
| 6,704,965 | B2 * | 3/2004 | Ale et al. | 15/167.1 |
| 7,051,395 | B2 | 5/2006 | Domke | |
| 7,074,390 | B2 | 7/2006 | MacKinnon | |
| 2003/0074755 | A1 | 4/2003 | Ale et al. | |
| 2004/0175334 | A1 | 9/2004 | MacKinnon | |

* cited by examiner

*Primary Examiner* — Shay Karls
(74) *Attorney, Agent, or Firm* — Richard C. Litman

(57) ABSTRACT

The siwak tooth cleaning instrument provides a carrying, protecting and application instrument for a siwak stick, to be applied to the user's teeth for cleaning thereof. In some embodiments, the siwak tooth cleaning instrument includes a tubular housing with a siwak that may be selectively and adjustably raised and lowered to extend the siwak from the housing for cleaning one's teeth, and retracted within the housing for storage and transport, similar to a lipstick. In other embodiments, the siwak tooth cleaning instrument has tooth cleaning cartridges including a siwak that releasably engage the head portion of an elongated handle. A cover may be pivotally attached to the handle for covering the handle and attached cartridge, or a storage tube with replacement cartridges may be pivotally attached to the handle.

5 Claims, 5 Drawing Sheets

SIWAK TOOTH CLEANING INSTRUMENT

BACKGROUND OF THE INVENTION

1. Field of the Invention

The present invention relates to toothbrushes, dentifrices, and other articles for cleaning one's teeth, and particularly to various forms of a siwak tooth cleaning instrument that provide dental appliances incorporating a siwak for brushing one's teeth.

2. Description of the Related Art

The siwak (also commonly referred to as a sewak, miswak or miswaak) is a natural toothbrush commonly used in Islamic communities. Muhammad, the prophet of the Islam religion, recommended its use, and brushing one's teeth with a siwak is now seen as an act of worship.

A siwak is typically made from the twigs or sticks of the *Salvadora persica* (commonly known in Arabic as Arak or Araak) tree, which grows in the Arabian Peninsula and in some parts of Asia and Africa. Traditionally, when the arak tree is not available, other types of trees have been used in the formation of a siwak-type stick for brushing of the teeth; namely, the olive tree, walnut tree, peelo (sometimes written as peelu in English) tree, and the neem tree. Other trees with substantially bitter roots may also be used.

The siwak made from the roots of the Arak tree is considered to be particularly advantageous, in that the tree root acts as a natural toothbrush with toothpaste. Chemical analysis has shown that the root contains natural substances that act as antiseptic agents, killing harmful microorganisms in the mouth. Further the root includes tannic acid, which has an astringent effect for protecting the gums against gum disease, and also aromatic oils, which aid in increasing saliva production.

Users typically carry a siwak with them for frequent brushing of their teeth. Unlike a conventional toothbrush, the siwak does not require an additional dentifrice, such as toothpaste, to be carried with it. Further, usage of the siwak does not involve typical toothpaste-related practices, which some may find offensive, such as vigorous brushing, the foaming of the toothpaste in and around the mouth, and spitting of the toothpaste and saliva.

A typical siwak is a relatively straight twig or stick, approximately eight inches in length. If the stick is dry, it is generally immersed in water prior to use. Prior to application to the user's teeth, the user scrapes off approximately ½ inches of bark from one end of the stick. The scraped tip is then gently chewed to separate the stick's fibers, thus forming bristle-like elements at the end of the stick. These bristle-like fibers are then brushed against the teeth (and used for massaging the gums) in a conventional manner. Following brushing, the chewed and bristled tip is washed with water and stored in a clean location. After the bristles lose their aroma and/or taste (indicating that the tannic acid and aromatic oils have been removed through the brushing process), they are cut off, and the user creates a new bristled tip, as described above.

In practice, the above process may be impractical for modern users. A user may forget to carry his or her siwak, sanitary locations for storage may not easily be found, and users in mixed cultures may find it inconvenient to use the siwak stick. A portable and sanitary siwak-based tooth cleaning system would be desirable. Thus, a siwak tooth cleaning instrument solving the aforementioned problems is desired.

SUMMARY OF THE INVENTION

The siwak tooth cleaning instrument provides for storage, transport, and application of a siwak for cleaning one's teeth.

In some embodiments, the siwak tooth cleaning instrument includes a tubular housing in which a siwak may be stored, and selectively and adjustably raised and lowered. When raised, an upper end of the siwak extends from the housing for application to the user's teeth for cleaning thereof. Following cleaning of the user's teeth, the user may lower the siwak within the housing for storage thereof.

Any suitable mechanism may be provided for selectively raising and lowering the siwak within the housing. Preferably, the mechanism for raising and lowering the siwak is similar to those typically associated with lipstick containers and deodorant applicators, i.e., through rotation of a knob mounted to a lower end of the housing, the user drives the siwak upward and downward within the housing. Such mechanisms have been described in U.S. Pat. Nos. 3,620,632; 3,706,500; 3,850,183; and 4,579,134, which are hereby incorporated by reference in their entirety.

A cap is preferably provided for releasably covering and sealing the open upper end of the housing. The cap may include a clip mounted thereon for selectively retaining the tooth cleaning instrument to a pocket of the user's clothing or the like.

In other embodiments, the siwak tooth cleaning instrument includes an elongated handle adapted for grasping by the user. A head portion is mounted on one end of the handle, and a removable and replaceable tooth cleaning cartridge is releasably attached to the head portion. A siwak is mounted on the tooth cleaning cartridge, so that the user may apply hold the handle while applying the siwak to his or her teeth for cleaning thereof. The bristled-tips on the siwak may be preformed, thus rendering it unnecessary for the user to constantly chew and reform bristled tips. When the siwak is used to completion, it may be easily removed and replaced with a fresh siwak.

The handle may have a cover pivotally attached thereto, the cover defining a channel that receives the handle and a cap portion defining a socket that receives the siwak cartridge and the head portion of the handle. Alternatively, the handle may be hollow and define a channel that receives a storage tube pivotally attached to the handle. The storage tube is used to store replacement siwak cartridges. A cap may be removably attached to the end of the storage tube, the cap defining a socket that forms a snap or friction fit with the head portion of the handle, thus providing a handheld applicator for the siwak that may be folded for carriage in one's pocket and includes an attached storage container with replacement siwak cartridges.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed towards siwak tooth cleaning instruments, which may be realized in several different forms. The siwak tooth cleaning instruments provide an applicator for using a siwak to clean one's teeth, and may also provide a compact device for storage and transport in one's pocket, making the siwak portable, practical, and hygienic.

Figure 1:
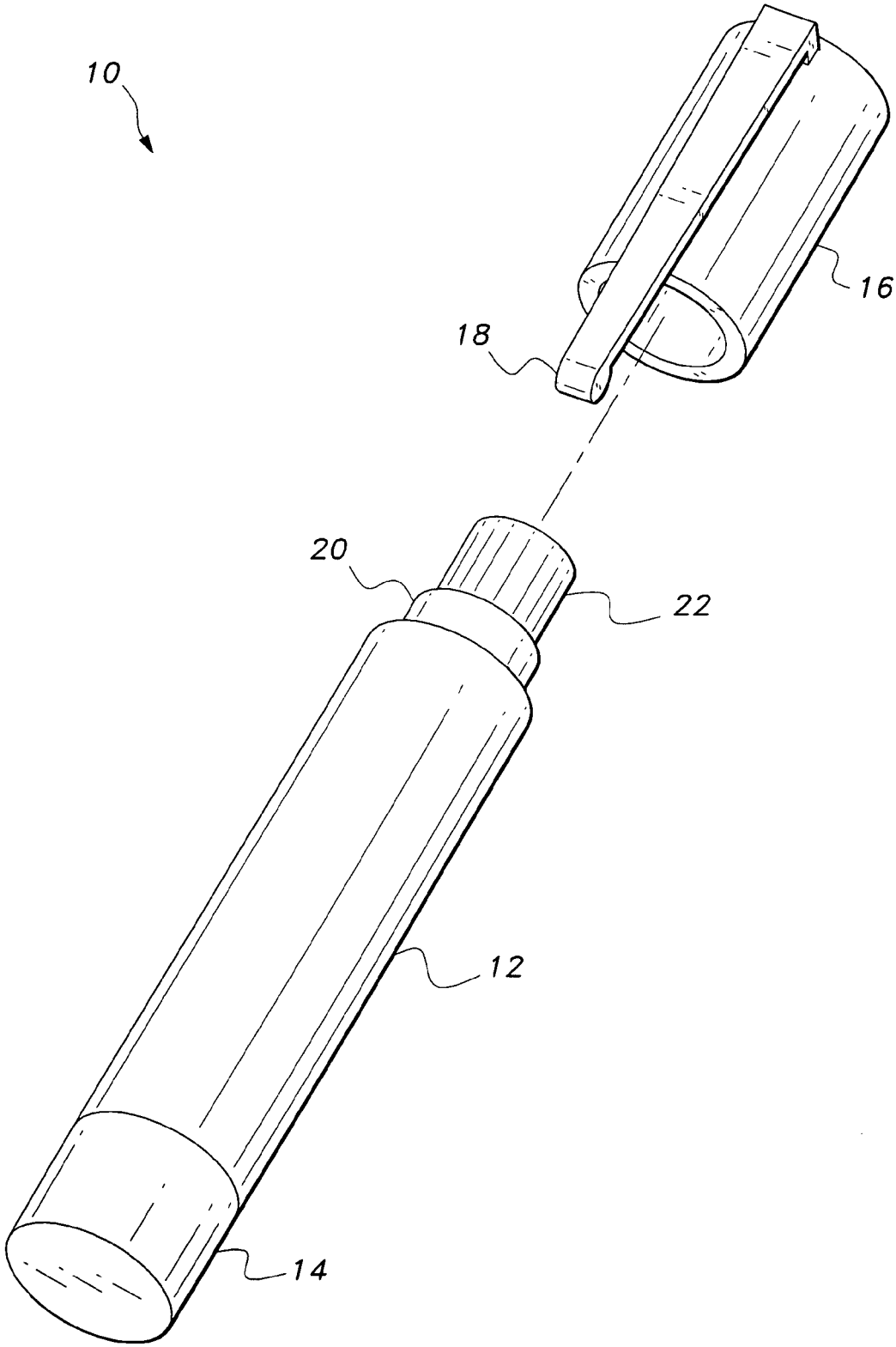
FIG. 1 is a perspective view of a first embodiment of a siwak tooth cleaning instrument according to the present invention as seen from below, the cap being removed from the housing.

As best shown in FIG. 1, a first embodiment of a siwak tooth cleaning instrument 10 includes a tubular housing 12, which defines an open interior region therein. The siwak 22, which is formed from a twig from the root of the *Salvadora persica* (Arak tree) or an acceptable substitute, is mounted within the tubular housing 12, which includes a mechanism similar to that used in lipsticks and lip balm tubes that provides for selectively and adjustably raising and lowering the siwak 22 in order to extend a working portion of the siwak from the mouth 20 of the housing upon rotation of the base 14.

Figure 2A:
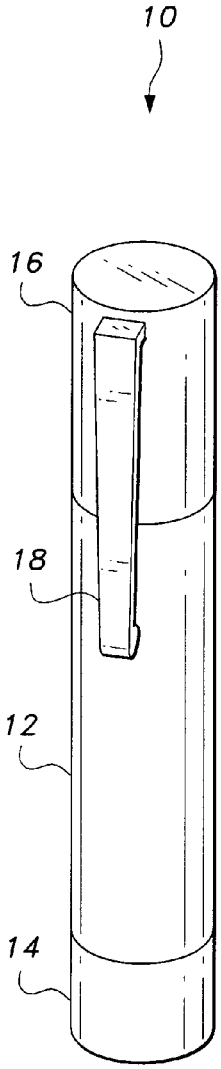
FIG. 2A is a perspective view of the siwak tooth cleaning instrument of FIG. 1, the cap covering the housing.
Figure 2B:
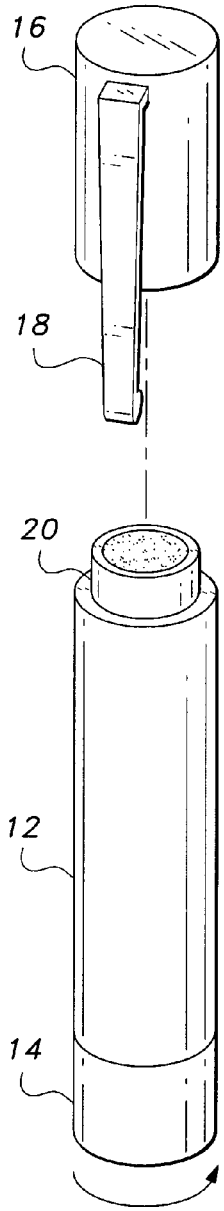
FIG. 2B is a perspective view of the siwak tooth cleaning instrument of FIG. 1 as seen from above, the cap being removed and the siwak being retracted into the housing.
Figure 2C:
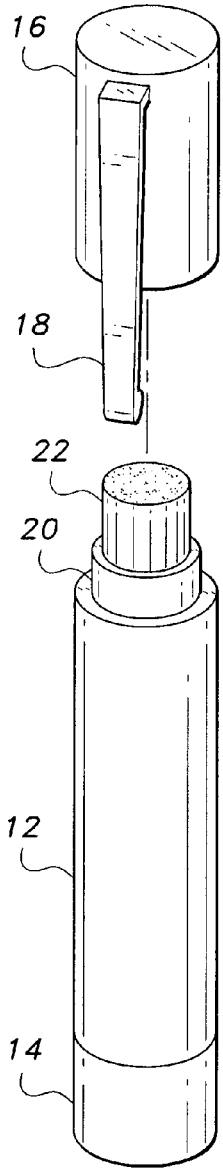
FIG. 2C is a perspective view of the siwak tooth cleaning instrument of FIG. 1 as seen from above, the cap being removed and the siwak being extended from the housing for use.

As best shown in FIG. 2A, the siwak 22 and housing 12 are initially covered by a cap 16, allowing the siwak 22 to be transported or stored in a sanitary and hygienic manner. To use the siwak tooth cleaning instrument 10, the user removes the cap 16, as shown in FIG. 2B, and rotates base 14 (to be described in greater detail below). Selective rotation of base 14 drives the selective raising of the siwak 22 within housing 12, thus exposing the upper, bristled end of the siwak 22 (shown in FIGS. 1 and 2C) for application to the user's teeth.

Through selective raising of the siwak 22, the upper end of the siwak 22 projects through an open mouth 20 of the tubular housing 12 for application to the user's teeth for cleaning thereof. In the drawings, the mouth 20 is shown as defining a recessed, annular portion formed on the upper portion of housing 12, defining a shoulder that serves as a stop for the cap 16. Following cleaning of the user's teeth, the user may lower the siwak 22 (through rotation of base 14 in the opposite direction) within the housing 12 or storage thereof.

Any suitable mechanism may be provided for selectively raising and lowering the siwak 22 within the housing 12. Preferably, the mechanism for raising and lowering the siwak 22 is similar to those typically associated with lipstick, lip balm, and deodorant applicators, i.e., through rotation of base 14 mounted to the lower end of the housing 12, the user drives the siwak 22 upwardly and downwardly within the housing 12. Such mechanisms are well-known in the art. Examples of such mechanisms are shown in U.S. Pat. Nos. 3,620,632; 3,706,500; 3,850,183; and 4,579,134, which are hereby incorporated by reference in their entirety.

As noted above, cap 16 is provided for releasably covering and sealing the open upper end 20 of the housing 12. The cap 16 may include a clip 18 mounted thereon for selectively retaining the tooth cleaning instrument 10 to a pocket of the user's clothing or the like. Clip 18 is preferably configured similarly to clips typically associated with ballpoint pens and the like, as shown, although any suitable clip may be used.

Figure 3:
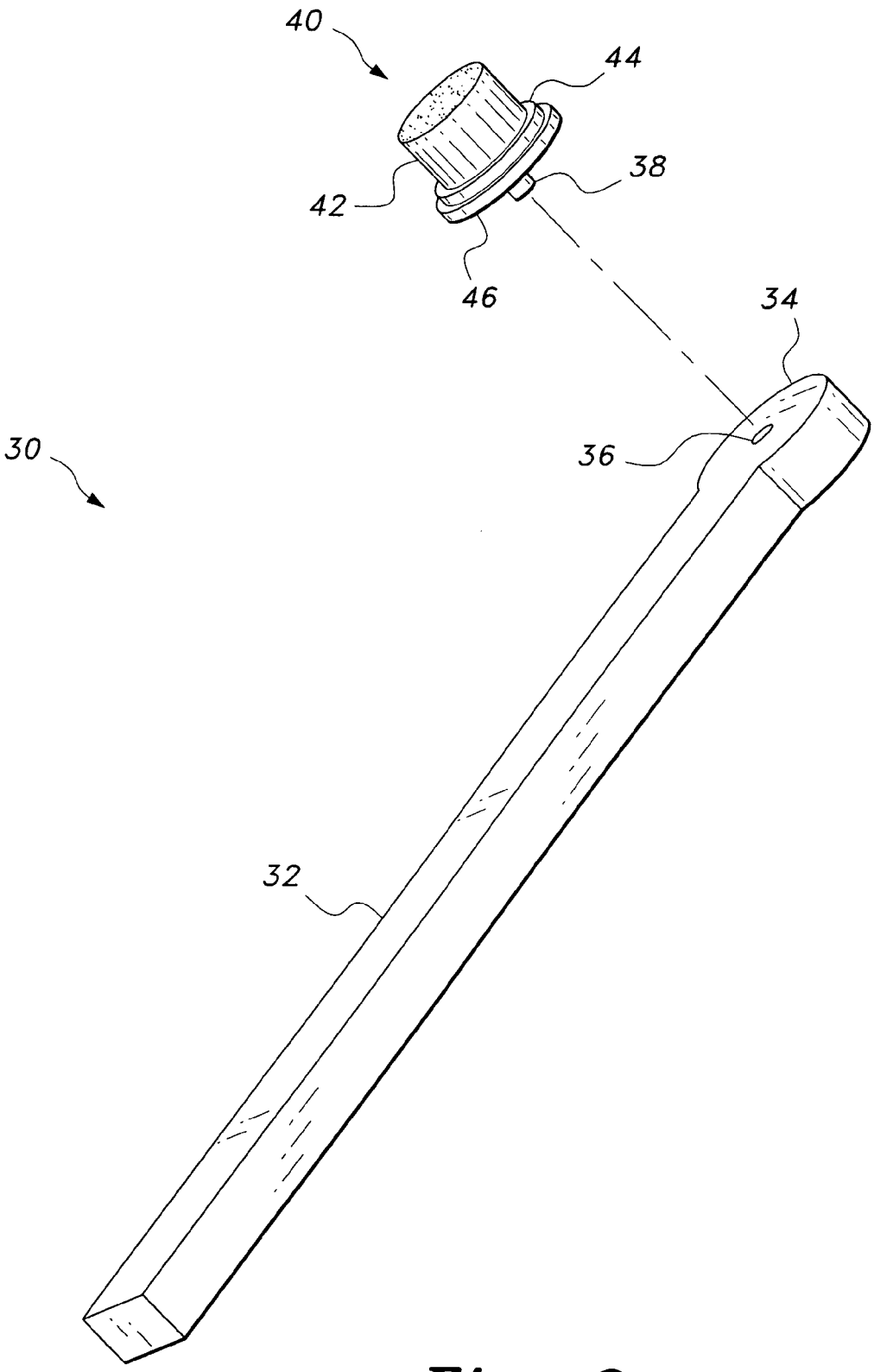
FIG. 3 is a perspective view of a second embodiment of a siwak tooth cleaning instrument according to the present invention.

In the alternative embodiment of FIG. 3, the siwak tooth cleaning instrument 30 includes an elongated handle 32 having a head portion 34 at one end. A removable and replaceable tooth cleaning cartridge 40 is releasably secured to the head portion 34. A siwak 42, pre-peeled with the fibers separated to form bristles, is attached to the tooth cleaning cartridge 40.

Cartridge 40 includes a base 46 with a raised annular mount 44 positioned thereon. The siwak 42 is secured to the annular mount 44. It should be understood that this arrangement is shown for exemplary purposes only, and that cartridge 40 may have any desired configuration.

The bristled tip on the siwak 42 is pre-formed, thus removing the necessity of the user to constantly chew and re-form bristled tips. When one siwak stick 42 is used to completion, it may be easily removed (via separation of cartridge 40 from head portion 34) and replaced with a fresh cartridge 40, containing a new siwak stick 42.

A projecting member 38 extends from the tooth cleaning cartridge 40 opposite the siwak 42. The projecting member 38 snaps into an opening 36 formed through the head portion 34. The projecting member 38 and snap opening 36, as well as the cylindrical shape of the cartridge 40 and head portion 34, are shown for exemplary purposes only, and any configuration of cartridge 40 upon which a single use portion of siwak is mounted that can be releasably attached to a handle that can be gripped by a user for brushing one's teeth is intended to be within the scope of the present invention.

Figure 4:
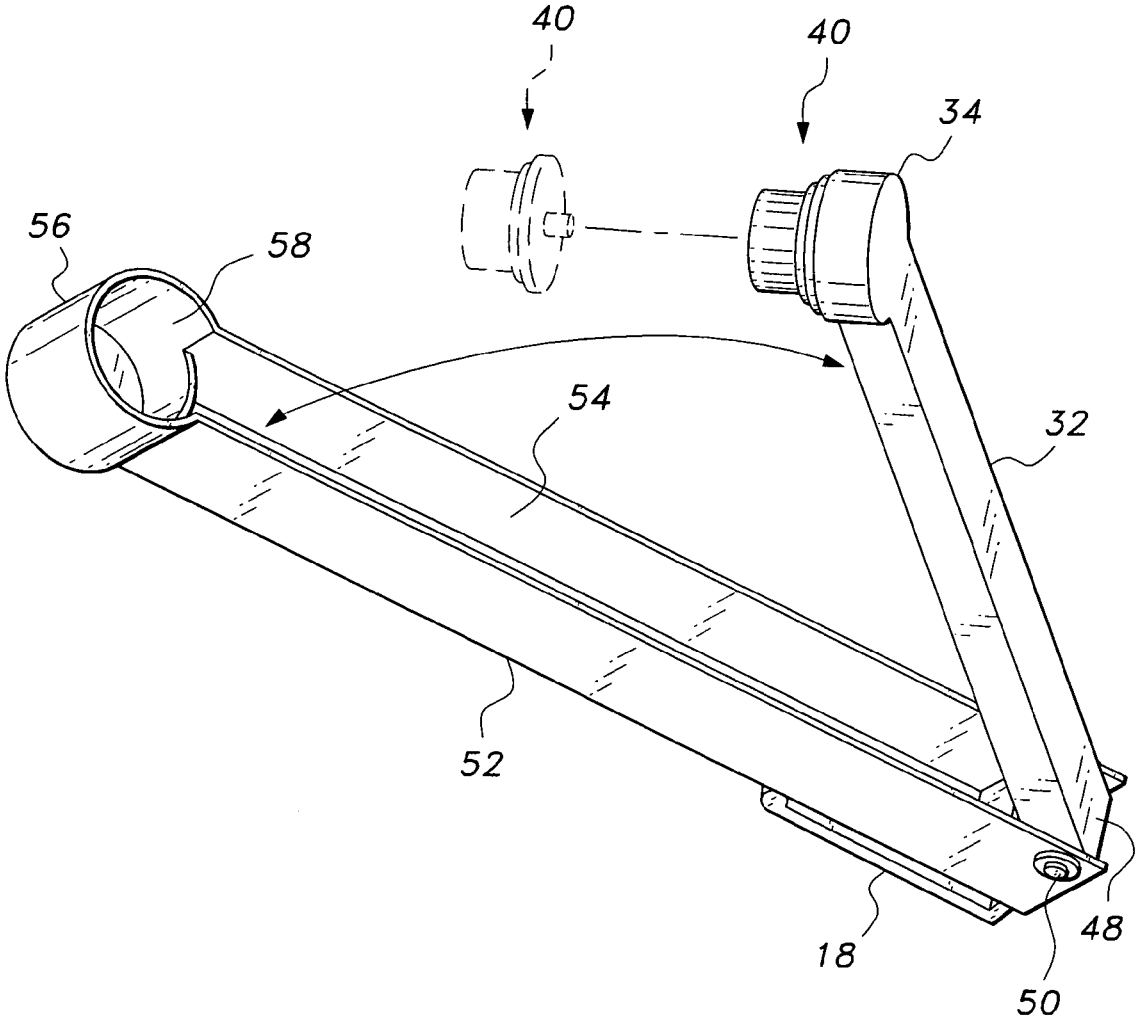
FIG. 4 is a perspective view of a third embodiment of a siwak tooth cleaning instrument according to the present invention.

In the alternative embodiment of FIG. 4, a cover 52 is pivotally attached to the end of the handle 32 opposite head portion 34, e.g., by pivot pin 50. The cover 52 defines and elongated channel 54 that receives the body of the handle 32 and a cap 56 defining a socket 58 that receives the. siwak 42 and the head portion 34, the head portion 34 forming a snap fit or friction fit with the cap 56 to releasably retain the body of the handle 32 in the channel 54 and the head portion 34 in the socket 58. A clip 18 may be attached to the cover 52. The cover 52 provides a clean and hygienic structure for carrying and transporting the handle 32 applicator for the siwak.

Figure 5:
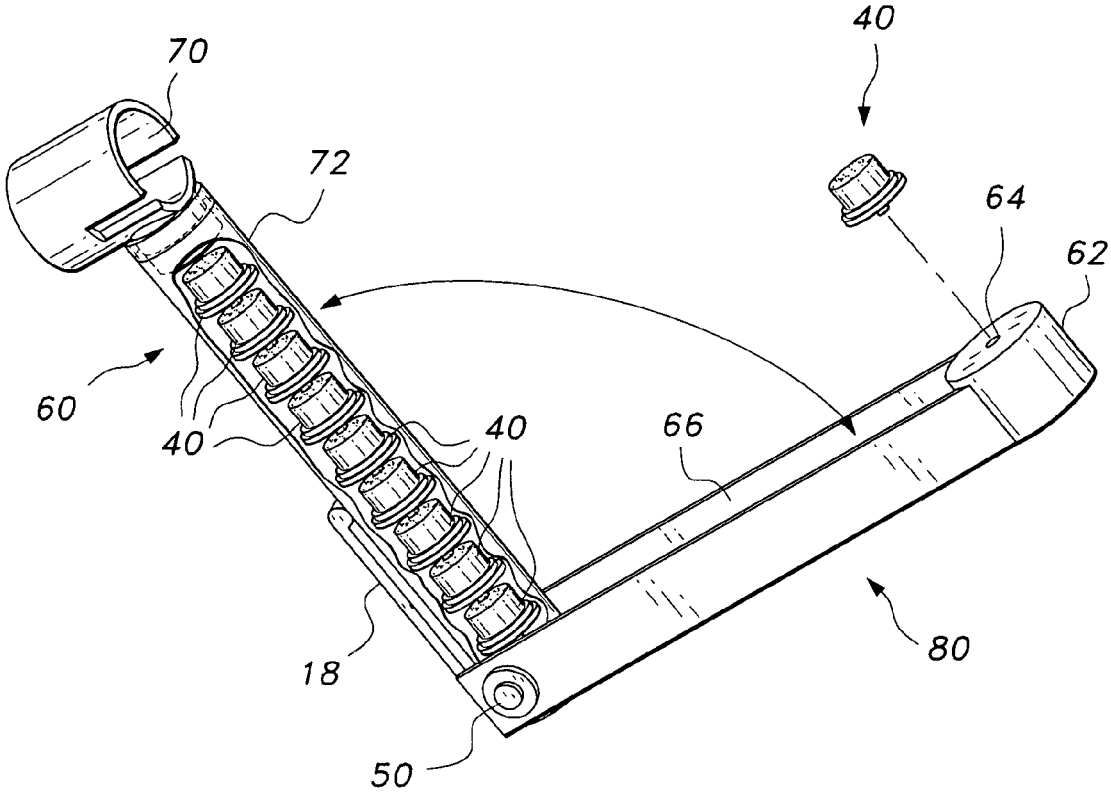
FIG. 5 is a perspective view of a fourth embodiment of a siwak tooth cleaning instrument according to the present invention, with the storage tube broken away and partially in section to show replacement cartridges disposed in the storage tube.

Alternatively, as shown in FIG. 5, the siwak cartridge 40 may be releasably attached to the head portion 62 of an elongated, hollow handle 80 that defines a channel 66. The head portion 62 may have an opening 62 that the cartridge 40 snaps into, similar to the handle 32 described in FIG. 3. An elongated, hollow storage tube 60 may be pivotally attached to the end of handle 80 opposite head portion 62, e.g., by pivot pin 50. A cap 70 defining a socket that receives the siwak cartridge 40 and head portion 62 by releasable snap or friction fit is attached to the end of storage tube 60 opposite pivot pin 50, e.g., by a snap or threaded connector.

The storage tube 60 defines a chamber 72 that stores a plurality of replacement siwak cartridges 40 that can be removed from storage tube 72 one at a time by removal of cap 70 in order to replace the cartridge 40 currently attached to the head portion 62 when it becomes depleted through use. Thus, handle 80 provides an applicator for holding a short length of siwak 40 that might otherwise be too short to hold by hand, a case or cap 70 for transporting the applicator handle 60 in a convenient, hygienic manner, and a storage container (tube 60) for storing and transporting replacement cartridges 40 with the applicator handle 80 in a compact package. A clip 18 may be attached to storage tube 18 for carrying the handle 80 in one's pocket.

It is to be understood that the present invention is not limited to the embodiments described above, but encompasses any and all embodiments within the scope of the following claims.

We claim:

1. A siwak tooth cleaning instrument, comprising:

an elongated handle having opposing ends and a head portion at one of the ends, said handle defining an elongated channel;

an elongated, hollow storage tube pivotally attached to the end of said handle opposite the head portion, the storage tube having an open end;

a tooth cleaning cartridge;

a siwak mounted on the tooth cleaning cartridge;

means for releasably attaching the tooth cleaning cartridge to the head portion of the handle, whereby a user grasps the handle while cleaning one's teeth with the siwak;

a cap removably disposed over the open end of said storage tube, the cap defining a socket receiving the siwak and releasably engaging the head portion of said handle in order to cover the siwak for storage and transport, the storage tube being disposed in the channel defined by said handle when the cap engages the head portion.

2. The siwak tooth cleaning instrument as recited in claim 1, wherein the head portion of said handle has an opening defined therein, said means for releasably attaching said tooth cleaning cartridge comprising a projecting member releasably engaging the opening in the head portion.

3. The siwak tooth cleaning instrument as recited in claim 2, further comprising a plurality of the tooth cleaning cartridges stored in said storage tube for replacement of the tooth cleaning cartridge attached to the head portion upon exhaustion of the siwak.

4. The siwak tooth cleaning instrument as recited in claim 1, further comprising an elongated cover having an end pivotally attached to said handle at the end of said handle opposite the head portion.

5. The siwak tooth cleaning instrument according to claim 4, wherein said cover comprises a cap opposite the end of said cover pivotally attached to said handle, the cap defining a socket receiving the siwak and releasably engaging the head portion of said handle in order to cover the siwak for storage and transport.

* * * * *